United States Patent [19]

Morris et al.

[11] Patent Number: 4,560,452

[45] Date of Patent: Dec. 24, 1985

[54] UNITARY CENTRAL CELL ELEMENT FOR DEPOLARIZED, FILTER PRESS ELECTROLYSIS CELLS AND PROCESS USING SAID ELEMENT

[75] Inventors: Gregory J. E. Morris, Lake Jackson; Sandor Grosshandler, Houston; Richard N. Beaver, Angleton; John R. Pimlott, Sweeny; Hiep D. Dang, Lake Jackson, all of Tex.

[73] Assignee: The Dow Chemical Company, Midland, Mich.

[21] Appl. No.: 682,736

[22] Filed: Dec. 17, 1984

Related U.S. Application Data

[63] Continuation-in-part of Ser. No. 472,792, Mar. 7, 1983, Pat. No. 4,488,946.

[51] Int. Cl.[4] ..... C25B 1/46; C25B 11/03; C25B 9/00; C25B 13/00

[52] U.S. Cl. ..... 204/98; 204/128; 204/254; 204/279; 204/286; 204/297 R

[58] Field of Search ..... 204/98, 128, 254–256, 204/268, 279, 286, 297 R

[56] References Cited

U.S. PATENT DOCUMENTS

| | | | |
|---|---|---|---|
| 3,124,520 | 3/1964 | Juda | 204/86 |
| 3,752,757 | 8/1973 | Stephenson, III et al. | 204/256 |
| 3,788,966 | 1/1974 | Stephenson, III et al. | 204/256 |
| 3,859,197 | 1/1975 | Bouy et al. | 204/284 |
| 3,884,781 | 5/1975 | Bouy et al. | 204/98 |
| 3,948,750 | 4/1976 | Figueras et al. | 204/286 |
| 3,960,698 | 6/1976 | Bortak | 204/267 |
| 3,960,699 | 6/1976 | Bortak et al. | 204/268 |
| 4,017,375 | 4/1977 | Pohto | 204/255 |
| 4,040,934 | 8/1977 | Hoekje et al. | 204/256 |
| 4,105,515 | 8/1978 | Ogawa et al. | 204/98 |

(List continued on next page.)

FOREIGN PATENT DOCUMENTS

| | | | |
|---|---|---|---|
| 0051435 | 5/1982 | European Pat. Off. | 204/267 |
| 0051437 | 5/1982 | European Pat. Off. | 204/266 |
| 0080288 | 6/1983 | European Pat. Off. | 204/286 |
| 0107612 | 5/1984 | European Pat. Off. | 204/98 |

OTHER PUBLICATIONS

Chin, D. T., Yeo, R. S., McBreen, J., Srinivasan, S. "An Electrochemically Regenerative Hydrogen-Chloride Energy Storage System", *Journal of the Electrochemical Society*, vol. 126, pp. 713–720, 1979.

Kaufmann, Dale W., Chapter 10, pp. 201–203, *Sodium Chloride the Production and Properties of Salt and Brine*, Copyright 1960 by Reinhold Publishing Corporation, New York.

Mitchell, D. R. and Kessler, H. D., "The Welding of Titanium to Steel", reprinted from *Welding Journal*, Dec. 1961.

*Primary Examiner*—Andrew H. Metz
*Assistant Examiner*—Terryence Chapman
*Attorney, Agent, or Firm*—J. H. Dickerson

[57] ABSTRACT

Unitary, cast structural element for filter press depolarized electrolysis cell which incorporates into a single unit the central barrier between the peripheral boundaries for the adjacent anode compartment and adjacent cathode compartment of two electrolysis cells located on opposite sides of the central barrier. At least one of such compartments also contains a gas chamber. An oxygen-containing gas may be fed into a depolarized cathode chamber or an hydrogen-containing gas may be fed into a depolarized anode chamber. Also incorporated into the single cast structural element are anode bosses and cathode bosses extending outwardly from opposite sides of the central barrier. These bosses not only serve as mechanical support for their respective flat plate anode and cathode, but also they serve as stand-off means and electrical current collectors and disperses from the cathode of one electrolysis cell to the anode of the next cell. Simplicity of design coupled with incorporation of many functional elements into one part eliminates many cell warpage problems, inherent high voltage problems and membrane "hot spot" problems.

49 Claims, 6 Drawing Figures

U.S. PATENT DOCUMENTS

| | | | |
|---|---|---|---|
| 4,108,742 | 8/1978 | Seko et al. | 204/98 |
| 4,111,779 | 9/1978 | Seko et al. | 204/255 |
| 4,115,236 | 9/1978 | Smura | 204/254 |
| 4,116,805 | 9/1978 | Ichisaka et al. | 204/290 F |
| 4,116,807 | 9/1978 | Peters | 204/290 F |
| 4,137,144 | 1/1979 | Kenney | 204/268 |
| 4,137,145 | 1/1979 | Wallace | 204/290 R |
| 4,149,952 | 4/1979 | Sato et al. | 204/258 |
| 4,155,820 | 5/1979 | Ogawa et al. | 204/98 |
| 4,178,218 | 12/1979 | Seko | 204/98 |
| 4,187,350 | 2/1980 | McIntyre et al. | 429/45 |
| 4,194,670 | 3/1980 | Ichisaka et al. | 228/179 |
| 4,202,743 | 5/1980 | Oda et al. | 204/98 |
| 4,213,833 | 7/1980 | Lefevre | 204/98 |
| 4,224,129 | 9/1980 | McIntyre et al. | 204/263 |
| 4,242,185 | 12/1980 | McRae | 204/98 |
| 4,247,376 | 1/1981 | Dempsey et al. | 204/128 |
| 4,256,545 | 3/1981 | Deborski | 204/290 R |
| 4,260,469 | 4/1981 | McIntyre et al. | 204/265 |
| 4,269,691 | 5/1981 | Deborski | 204/290 R |
| 4,273,628 | 6/1981 | Kidon et al. | 204/98 |
| 4,279,731 | 7/1981 | Pellegri | 204/254 |
| 4,294,671 | 10/1981 | Balko | 204/128 |
| 4,312,720 | 1/1982 | Lefevre | 204/78 |
| 4,317,704 | 3/1982 | McIntyre et al. | 204/1 R |
| 4,339,322 | 7/1982 | Balko et al. | 204/255 |
| 4,341,606 | 7/1982 | McIntyre et al. | 204/98 |
| 4,357,218 | 11/1982 | Seko | 204/98 |
| 4,364,815 | 12/1982 | Darlington et al. | 204/283 |
| 4,381,230 | 4/1983 | Burney, Jr. et al. | 204/98 |
| 4,384,937 | 5/1983 | Shuster et al. | 204/257 |

CATHODE SIDE

ANODE SIDE

UNITARY CENTRAL CELL ELEMENT FOR DEPOLARIZED, FILTER PRESS ELECTROLYSIS CELLS AND PROCESS USING SAID ELEMENT

CROSS REFERENCE TO RELATED APPLICATION

This application is a continuation-in-part of copending application Ser. No. 472,792 filed Mar. 7, 1983 now U.S. Pat. No. 4,488,946.

BACKGROUND OF THE INVENTION

This invention relates to an improvement in the structure of bipolar depolarized electrode-type, filter press-type electrolysis cells. More particularly it relates to those of such cells which employ permselective ion exchange membranes planarly disposed between flat surfaced, parallel, porous, depolarized anodes and cathodes when said anodes and cathodes are mounted at a distance from the fluid impermeable structure of the bipolar electrode which physically separates adjacent electrolysis cells. Such cells are particularly useful in the electrolysis of aqueous solutions of alkali metal chlorides; especially in the electrolysis of aqueous solutions of sodium chloride (sodium chloride brine). The cell structure may also be used in electrolyzing other solutions to make products such as potassium hydroxide, iodine, bromine, bromic acid, persulfuric acid, chloric acid, adiponitrile and other organic compounds made by electrolysis.

The unitary filter press central cell element of the present invention decreases the cost of manufacture of the cell units, decreases the labor required to assemble them, simplifies their manufacture, greatly reduces the warpage of the cell unit parts, and provides a much sturdier cell structure than do bipolar, filter press cells of the prior art.

Reducing the warpage of cell structure allows the cell to be operated more efficiently; i.e., produce more units of electrolysis products per unit of electricity. Reducing the warpage reduces the deviation from design of the gap width between the anode and cathode of each electrolysis cell. Ideally this gap width is uniformly the same between the anode and cathode in order to have a uniform current density spread between the faces of the cell electrodes. Among other things, structural warpage causes deviation of this gap resulting in some parts of the anode and cathode being closer together than others. At these locations, the electrical resistance is less, the electrical current is more, and thus the electrical heating is greater. This electrical heating is sufficient in many instances to cause damage to the membrane at these locations. These locations of unacceptably high electrical current concentration and high heat are referred to herein as "hot spots".

To avoid these hot spots, the prior art has had to design its cell structures with a greater than desired gap width between the anode and cathode of each electrolysis cell. This, of course, increases the cell operating voltage and decreases the cell operating efficiency. Complexity of design and fabrication is another drawback of those cells.

Except for the structures used for the terminal cells of a bipolar filter press cell series, the structures for the intermediate cells in the series are like, repetitious, cell structural units which are squeezed together. Examples of such cells operated in a cell series are disclosed in Seko, U.S. Pat. No. 4,111,779 (Sept. 5, 1978) and in Pohto, U.S. Pat. No. 4,017,375 (Apr. 12, 1977).

At this point, a clarification should be made about confusing nomenclature sometimes encountered when speaking of a series of bipolar filter press cells. The problem involves the nomenclature often encountered when dealing with the repeating electrolysis cells and the repeating cell structure units used to house these repeating electrolysis cells. In the electrolysis cells there is a membrane planarly disposed in or about the center of each electrolysis cell between a parallel anode and cathode. The membrane divides the electrolysis cell itself into an anolyte and cathode compartment. However, in appearance in a cell series the membrane often appears to be the division line between repeating cell units. In fact, it often is located at the division between repeating cell structures in the series, but not at the line separating different electrolysis cells. This comes about because the repeating cell structures are situated between and around parts of adjacent, but different, electrolysis cells. Such a repeating cell structure includes structure which defines the periphery of the cathode compartment of one of two adjacent electrolysis cells. This repeating cell structure includes structure which defines the periphery of the anode compartment of the other of the two adjacent electrolysis cells and the barrier structure separating the two electrolysis cells. So the anode compartment and the cathode compartment associated with a given repeating structural unit are compartments of adjacent, but different, electrolysis cells.

These repeating cell structures include several other structural elements which will be discussed below. Herein this repeating structural unit will be referred to as a "bipolar electrode-type, filter press-type electrolytic cell unit". As used with the present invention, this cell unit is referenced in the drawing by reference number 10.

The cell of the present invention is particularly well suited for use with depolarized electrodes. Such electrodes may take the form of depolarized cathodes, where an oxygen-containing gas is contacted with one side of the cathode and an electrolyte is contacted with another side of the cathode. The cathode is a porous body which allows both the gas and the electrolyte to enter. Inside the cathode, with the addition of electrical energy from a power supply, electrochemical reactions are caused to occur. In the case of chlor-alkali cells, hydroxyl ions are produced without the production of hydrogen.

In the case of depolarized anodes, a hydrogen-containing gas is contacted with one side of an anode and an electrolyte is contacted with another side of the anode. The anode is porous and allows both the gas and the electrolyte to enter. Electrochemical reactions are caused to occur within the internal portions of the anode. In the case of chlor-alkali cells, hydrogen gas may be contacted with one side of the anode and a sodium chloride brine solution contacted with another side of the anode, to produce HCl.

Patents which teach various types of depolarized cathodes include: U.S. Pat. Nos. 4,187,350; 4,213,833; 4,224,129; 4,256,545; 4,260,469; 4,269,691; 4,312,720; 4,317,704; 4,341,606; 4,406,758; 4,445,896; European Patent Application Nos. 0,051,432; 0,051,435; 0,051,437 and 0,051,439.

References which include depolarized anodes include: U.S. Pat. Nos. 3,124,520; 4,447,322; European Patent Application No. 107,612-A and "An Electrochemically Regenerative Hydrogen-Chlorine Energy Storage System", D. T. Chin, R. S. Yeo, J. McBreen, S. Srinivasan, *Journal of Electrochemical Society,* Volume 126, page 713, 1979.

There are other structural elements included in a bipolar electrode-type, filter press-type electrolytic cell unit besides the electrolyte compartments peripheral structure and the electrolyte impervious central barrier. These include an anode, a cathode, an anode stand-off means, a cathode stand-off means, current collectors, gaskets, gas compartments and an electrical current transfer means. The permselective ion-exchange membranes are usually not considered as part of this structural unit although they are present.

The central barrier separates the anode compartment of one adjacent electrolysis cell from the cathode compartment of the other adjacent electrolysis cell.

The anode and cathode are spaced from and spaced on opposite sides of the central barrier by the anode and cathode stand-off means, which also includes in the case of depolarized electrodes, by a gas chamber or chambers, respectively. This spacing is provided so as to provide room for the electrolyte and electrolysis products to circulate in the space between the electrodes and an ion exchange membrane.

The anode stand-off means and cathode stand-off means most often also serve as the electrical current means used to electrically connect the anode on one side of the barrier with the cathode on the opposite side of the barrier. This connection is made through the barrier.

The anode and cathode are usually of the "flat plate" type. That is, they present a planarly disposed working surface, or assembly of surfaces, to their respective membranes. They are most often parallelly disposed to their respective membranes, to the axis plane of the central barrier, and to each other. Usually the anode or the cathode is depolarized and the other electrode is not, although both may be depolarized.

The unpolarized anode compartment is defined by the space between the central barrier and the membrane disposed on the anode side of the central barrier as well as the structure fitted around and between the periphery of this membrane and central barrier. Note, the anode is disposed within the anode compartment by definition. Likewise the cathode compartment is defined as the space between the gas compartment and the membrane on the cathode side of the central barrier and by the peripheral structure fitted around and between the periphery of the central barrier and the membrane on the cathode side of the central barrier. Again the cathode is in the cathode compartment by definition. The anode or cathode compartment may contain a gas compartment.

The anode and cathode of a repeating unit structure (along with the central barrier and the electrical connecting means which electrically connects the anode to the cathode through the central barrier) are, of course, often referred to as a "bipolar electrode". This is because, in effect, this connection of structure series is as an anode in one electrolysis cell and a cathode in another electrolysis cell.

The above features of a flat plate bipolar electrode-type, filter press-type electrolytic cell unit can also be observed in the following references: 4,364,815; 4,111,779; 4,115,236; 4,017,375; 3,960,698; 3,859,197; 3,752,757; 4,194,670; 3,788,966; 3,884,781; 4,137,144; and 3,960,699.

A review of these patents discloses the above described structural elements in various forms, shapes and connecting means.

What is surprising to one not skilled in this art is the complexity of connections of these parts as well as the large number of parts required for what seems to be a relatively simple structural assembly problem. Of course, to those skilled in the art this complexity is well understood as the outgrowth of trying to make profitable commercial cell structures for use with the relatively new permselective ion-exchange membranes and the extremes of corrosive conditions extant between the anode and cathode compartments. These membranes operate best at elevated temperatures and high caustic concentrations, e.g., above about 80° C. and about 22% caustic catholyte concentrations. This compounds the problems of constructing profitable cells.

The problem centers around finding an affordable anode material and other materials which can withstand the extremely corrosive conditions of the anolyte chamber. For profitable, commercial operations, titanium is the material which has been found which has the most promise for profitable use.

However, there is a great disadvantage in the use of titanium with other metals suitable for use in the anolyte chamber. This is titanium's inability to form a good weld with ferrous materials and most other materials. This is most unfortunate because steel has been used quite successfully for many years as the cathode material.

The major reason for the complexity existing in the connections as well as the reason for having so many connections and so many separate parts in each filter press cell unit of the prior art stems from the necessity of using titanium coupled with the relatively high cost of titanium with respect to the cost of steel coupled with the necessity of establishing a very low electrical resistance connection between the anode and the cathode. The present invention greatly reduces the number of connections, number of separate parts, and the problems they cause. Further discussion of these problems will be better appreciated by perusing the prior art.

As stated above, one of the main problems is that titanium cannot be successfully welded directly to steel. See Seko, U.S. Pat. No. 4,111,779 at Column 1. Also see Mitchell, D. R.; Kessler, H. D.; "The Welding of Titanium to Steel", *Welding Journal* (Dec. 1961). In the Seko patent, titanium is joined to steel by explosion bonding steel plate to titanium plate. In the Mitchell et al *Welding Journal* article, titanium is indirectly welded to steel by welding through a vanadium intermediate placed between the steel and titanium.

The prior art discloses complex and elaborate schemes devised to electrically and/or mechanically connect the different parts of the cell wherein titanium and titanium alloys are employed. Particularly is this complexity seen to be true with respect to the parts herein referred to as stand-offs which connect the "flat plate" anode and cathode of a bipolar electrode structure to an electrically conductive central barrier at a spaced distance from the central barrier; e.g. Seko U.S. Pat. No. 4,111,779 and Ichisaka et al, U.S. Pat. No. 4,194,670. Other stand-offs are used to support the flat plate electrodes and to electrically and mechanically connect them through holes in a non-conductive central barrier, e.g., Stephenson III, et al, U.S. Pat. No. 3,752,757 and Bortak, U.S. Pat. No. 3,960,698. It will be noticed that in these connections, welds and/or bolts are used to connect the stand-offs to the electrodes and then again to the central barrier or to opposing stand-offs passing through the central barrier. Many problems are associated with these many connections. These problems would not be so formidable if only a few connections were required for each of the many cells in a series, but many are required for each cell to get adequate electrical current distribution.

The present invention reduces these problems by eliminating many of these connections. It does this by integrally casting these stand-offs with the central barrier. Moreover, the connections used to connect the central barrier to the peripheral structure of the anolyte and cathode compartment are also eliminated by integrally casting these structures with the central barrier.

Other problems associated with having so many such connections include unequal electrical current transfer, warpage of parts, and creation of more stress points in the titanium. Such stress points are subject to attack by atomic hydrogen as well as increased susceptibility to normal chemical corrosion and galvanic corrosion.

The electrical transfer capability of a bolted connection is dependent upon the sufficiency of the friction contact between the threads of the two mating threaded pieces. Many bolts are used in making the connections for each bipolar unit when they are depended upon to connect the electrodes and/or stand-offs. They are depended upon to carry equal amounts of current to avoid "hot spots" on the electrodes and adjacent membranes. However, this would require perfect equality of mating of all threaded surfaces. Perfection can not be closely approximated in these cells without going to extraordinary costs. Hence, "hot spots" do occur, and if they do not burn the membrane, they at least cause distorted electrolysis reaction rates across the face of the electrode.

As to welded connections, electrical transmission through them is dependent upon the percentage of the cross-sectional area of the supposed weld which is actually welded. Maldistribution of the amount of welded surface area from weld to weld across the face of a bipolar electrode is very difficult to avoid. Thus with maldistribution of welds, there occurs maldistribution of electric current which, like the threaded bolt problem, causes the undesired electrical "hot spots" on the membrane and "flat plate" electrodes.

Warpage is another undesired side effect of welding. Welding invariably causes warpage in the workpiece. Warpage problems may initially begin before fabrication. When working with large weldments, the individual parts themselves may not be straight, flat, smooth, etc., which will ultimately cause problems during and after fabrication. For proper alignment and positioning of parts, jigs and fixtures often are not adequate to compensate for such problems.

When working with large flat structures (such as cell bodies) the biggest concern lies with warpage that occurs due to the welding itself. Methods to correct such warpage may include heating/cooling, pressing, heating/pressing, and machining. All such methods of relieving warpage induced by welding, however, may in turn induce additional stresses in the structure and thereby cause secondary warpage in the part. These methods also increase the cost of the cell bodies.

In addition to warpage, other concerns which are common to welded structures include: (1) undesirable weld stresses within the part, (2) defective welds, (3) correcting welds which are defective, (4) examination of the weldment for flaws.

In both the all welded cell structures and the welded and bolted metal cell structures, it is difficult to maintain uniform planes between the anolyte and catholyte compartments. Consequently these non-uniform planes cause a non-uniform electrical current distribution across the active surface of the catholyte and anolyte chambers. Since the distribution of electric current is non-uniform, the electrical reactions are also non-uniform. It occurs vigorously at localized areas and thereby causes localized heating effects there, that is "hot spots".

Another problem associated with these non-uniform planes is that the anode and the cathode cannot be brought sufficiently close to each other without the fear of puncturing the membrane. Thus a large voltage loss is incurred because these electrodes can not be spaced as close to each other as desired.

All of the above leads to a shortening of the life of the electrolytic cell.

The present invention by comparison (cast unitary cell structures) has eliminated most of the problems listed above which are common to the weldment type structure and the welded and bolted structure. As a result, cell electrodes are more uniformly parallel; there is a more uniform distribution of electrical current and electrolytic reaction in the cell during operation; and the invention also provides a leakproof centerboard or central barrier.

Another undesired effect of threads and welds in titanium is that they create stress points in the titanium. These stress points are very susceptible to attack by atomic hydrogen. This attack forms significant concentrations of hydrides of titanium at temperatures greater than 80° C. These hydrides are structurally unsound and resistant to the passage of electricity. Thus the purposes for which these threads or welds were made in the first place are substantially undone when hydrides are formed thereat.

The source of this atomic hydrogen is primarily the catholyte chamber where water is electrolyzed to hydrogen and hydroxide. It would seem that little trouble would be expected in titanium located in the anode compartment from atomic hydrogen generated in the cathode compartment, particularly when there is a steel central barrier located between them.

However, this hydrogen diffuses through the steel and does attack titanium stress points with particular devastating results at temperatures greater than 80° C., the temperature above which membrane cells coincidently seem to operate best.

The atomic hydrogen attacks the titanium stress points directly connected to the steel. This is one of the flaws in the reasoning given for using a steel to titanium explosion bonded central barrier as is disclosed and claimed in Seko, U.S. Pat. No. 4,111,779. The whole bonded area of the titanium is under stress and is therefore subject to the hydride formation discussed above. At first no problem is detected because sufficient hydrogen has not penetrated the steel and reached the titanium. However, as the titanium hydride formation increases in these central barriers at the titanium steel bond, the electrical conductivity and the structural integrity decreases until the central barriers are worthless and even dangerous.

The present invention greatly reduces the risk of titanium hydride formation by creating a structure which has a titanium liner with only a relatively very few stress points in it, and also by locating these stress points at an extreme distance from the hydrogen source with respect to the amount of steel which must be traversed in order to reach any of these few stress points. The only stress points found in the present invention's titanium hot pressed liner are found at the sites where it is welded to the ends of the integrally cast anode bosses. These will be discussed below. It should be understood here, however, that although the present invention has been discussed principally in terms of the commonly used steel and titanium, it is not limited to these materials of construction, albeit they are the preferred material of construction.

SUMMARY OF THE INVENTION

The invention relates to a cell structure used in forming a bipolar, depolarized electrode, filter press electrolytic cell unit, which unit is capable of being combined with other cell units to form a cell series;

wherein in said series the cell structure is separated from adjacent cell structures by ion-exchange permselective membranes which are sealably disposed between each of the cell structures so as to form a plurality of electrolysis cells;

each of said electrolysis cells has at least one planarly disposed membrane separating each cell into two electrode compartments, an anode component and a cathode compartment, one or more gas compartments are also present;

wherein at least one of said electrode compartments comprises an electrolyte compartment in contact with the ion exchange membrane, a porous electrode component in contact with said electrolyte compartment and a gas chamber in contact with the porous electrode component on a side opposite the side contacting the electrolyte compartment;

said cell structure additionally has a central barrier which physically separates an anode compartment of an electrolysis cell located on one side of the barrier from a cathode compartment of an adjacent electrolysis cell located on the opposite side of the barrier;

said central barrier at least has a planarly disposed anode component situated in its adjacent anode compartment and at least has a planarly disposed cathode component situated in its adjacent cathode compartment, and one or more gas compartments;

said central barrier has the anode component of the adjacent anode compartment electrically connected through it to the cathode component of the adjacent cathode compartment;

said anode and cathode compartments which are adjacent to the central barrier has a peripheral structure around their periphery to complete the physical definition of said compartments;

said cell structure also has an electrical current transfer means associated with it for providing electrical current paths through the central barrier from its adjacent cathode compartment to its adjacent anode compartment;

which cell structure includes anode component and cathode component stand-off means for maintaining the anode component and cathode component of the two electrolysis cells adjacent to the central barrier at a predetermined distances from the central barrier; said has one or more gas compartments in part formed by the central barrier.

The improvement which comprises:

the central barrier, the anode and cathode compartment peripheral structures, the anode component stand-off means, the cathode component stand-off means, part of the gas compartment or compartments and at least part of the electrical current transfer means all being integrally formed into a unitary central cell element made from a castable material;

said castable material being electrically conductive so as to be the part of the electrical current transfer means which transfer electricity through the central barrier from the adjacent cathode compartment of the adjacent anode compartment; and said unitary central cell element being formed in such a fashion so as to provide the structural integrity required to physically support the contents of the adjacent electrolyte compartments as well as to support the associated electrolysis cell appurtenances which are desired to be supported by the unitary central cell element; and said anode component stand-off means and that part of the electrical current connecting means located in the unitary central cell element on the anode side of the central barrier being combined into a multiplicity of anode component bosses projecting a predetermined distance outwardly from the central barrier into the anode compartment adjacent to the central barrier, said anode component bosses being capable of being mechanically and electrically connected either directly or indirectly to the anode component of said anode compartment; and said cathode component stand-off means and that part of the electrical current connecting means located on the cathode side of the central barrier being combined into a multiplicity of cathode component bosses projecting a predetermined distance outwardly from the central barrier into the cathode compartment adjacent to the central barrier, said cathode component bosses being capable of being mechanically and electrically connected either directly or indirectly to the cathode component; and said gas compartment being formed in part by the central barrier and a picture frame and said anode component bosses being spaced apart in a fashion such that fluids can freely circulate throughout at least a portion of the adjacent anode component; and, likewise, said cathode component bosses being spaced apart in a fashion such that gas can freely circulate throughout at least a portion of the adjacent gas compartment;

a gas inlet or inlets passing through the peripheral structure of the central barrier into the one of the electrode chambers between the central barrier and its electrode component.

This particular cell unit is capable of being combined with other cell units to form a cell series. In said series the cell structure is separated from adjacent cell structures by ion-exchange, permselective membranes which are sealably disposed between each of the cell structures so as to form a plurality of electrolysis cells. Each of said electrolysis cells has at least one planarly disposed membrane defining and separating the anode compartment from the cathode compartment of each electrolysis cell. The cell structure of this particular cell unit has a central barrier which physically separates the anode compartment of an electrolysis cell located on one side of the barrier from the cathode compartment of an adjacent electrolysis cell located on the opposite side of the barrier. This central barrier has a planarly disposed foraminous, "flat plate" anode situated in its adjacent anode compartment and a planarly disposed, porous, "flat plate" cathode situated in its adjacent cathode compartment. Both electrode faces are substantially parallel to the membrane planarly disposed between them and to the central barrier. The central barrier has the anode of the adjacent anode compartment electrically connected through it to the cathode component of the adjacent cathode compartment. Optionally one, or both of the electrodes may be a depolarized electrode.

These anode and cathode compartments adjacent to the central barrier have a peripheral structure around their periphery to complete their physical definition. This cell structure also has an electrical current transfer means associated with it for providing electrical current passage through the central barrier from its adjacent cathode compartment to its adjacent anode compartment. This cell structure includes anode and cathode component stand-off means for maintaining the anode and cathode of the two electrolysis cells adjacent to the central barrier at predetermined distances from the central barrier.

The improvement of this particular cell structure comprises the central barrier, the anolyte and cathode compartment peripheral structures, the anode stand-off means, the cathode stand-off means, part of the gas compartments and at least part of the electrical current transfer means all being integrally formed into a unitary central cell element made from a single casting of a castable metal.

The invention employs the castable metal as part of the electrical current transfer means which transfers electricity through the central barrier from the adjacent cathode compartment to the adjacent anode compartment.

In the case of a depolarized anode or a depolarized cathode, a current collector may be positioned between the central barrier and the anode or cathode. The current collector supports and distributes electrical current to the electrode. The current distributor can take the form of wire mesh, mattresses, perforated plates, and other materials well known in the art of depolarized electrodes.

The unitary central cell element is so formed in such a fashion so as to provide the structural integrity required to physically support the associated electrolysis cell appurtenances which are desired to be supported by the unitary central cell element.

The anode stand-off means and that part of the electrical current connecting means located in the unitary central cell element on the anode side of the central barrier are combined into a multiplicity of anode bosses projecting a predetermined distance outwardly from the central barrier into the anode compartment adjacent to the central barrier. These anode bosses are capable of being mechanically and electrically connected either directly to the anode of said anode compartment or indirectly to said anode through at least one compatible metal intermediate directly situated in an abutting fashion between said anode and said anode bosses. Preferably these anode bosses all have ends which are flat surfaces which preferably lie in the same geometrical plane.

The cathode stand-off means and that part of the electrical current connecting means located on the cathode side of the central barrier are combined into a multiplicity of cathode bosses projecting a predetermined distance outwardly from the central barrier into the cathode compartment adjacent to the central barrier. These cathode bosses are capable of being mechanically and electrically connected either directly to the cathode component in said adjacent cathode compartment or indirectly to the cathode through at least one weldably compatible metal intermediate directly situated in an abutting fashion between said cathode component and said cathode bosses. Preferably these cathode bosses all have ends which are flat surfaces and which preferably lie in the same geometric plane.

The invention preferably further comprises anode bosses being spaced apart in a fashion such that fluids can freely circulate through the totality of the otherwise unoccupied adjacent anode compartment, and, likewise, said cathode bosses being spaced apart in a fashion such that gas can freely circulate throughout the totality of the adjacent gas compartment.

Preferably the castable material of the unitary central cell element is selected from the group consisting of iron, steel, stainless steel, nickel, aluminum, copper, chromium, magnesium, tantalum, zirconium, lead, vanadium, tungsten, iridium, rhodium, cobalt, alloys of each, and alloys thereof.

More preferably the metal of the unitary cell element is selected from the group consisting of ferrous materials. Ferrous materials are defined herein to mean metallic malerials whose primary consstiuent is iron.

A further element which this invention preferably includes is an anode side liner made of a metal sheet fitted over those surfaces on the anode compartment side of the cell structure which would otherwise be exposed to the corrosive environment of the anolyte compartments.

Preferably this anode side liner is an electrically conductive metal which is essentially resistant to corrosion due to the anode compartment environment, and preferably the metal liner is formed so as to fit over and around the anode bosses with the liner being connected to the unitary central cell element at the anode bosses more preferably connected at the ends of the anode bosses.

And preferably the invention comprises having the liner sufficiently depressed around the spaced anode bosses toward the central barrier in the spaces between the bosses so as to allow free circulation of the anolyte between the lined unitary central cell element and the membrane of the adjacent anolyte chamber. Note that the liner replaces the unitary central cell element surface adjacent to the anolyte chamber as one boundary contacting the anolyte.

More preferably, the metal liner is connected to the anode bosses by welding through a metal intermediate which is disposed between the bosses and the liner with the metal of the metal intermediate being weldably compatible with both the metal of the anode side liner and the metal of which the unitary central cell element is made, that is weldably compatible with both metals to the point of being capable of forming a ductile solid solution with them at welds of them upon their welding.

In most cases, such as in the construction of chlor-alkali cells, it is preferred that the unitary cell element be made of a ferrous material and the anode side liner be made of a metallic material selected from the group consisting of titanium, titanium alloys, tantalum, tantalum alloys, niobium, niobium alloys, hafnium, hafnium alloys, zirconium and zirconium alloys.

In situations where the anode side liner metal is not weldably compatible with the metal of the unitary cell element, then in order to be able to weld the liner to the structure, metal coupons are one type of metal intermediate which are suitable to be situated in an abutting fashion between the anode bosses and the anode side liner. Each coupon has at least two metal layers bonded together, with the outside metal layer of one side of the coupon abutting the anode boss and the outside metal layer of the opposite side of the coupon abutting the anode side liner. The metal layer of the coupons which abuts each anode boss is weldably compatible with the material of which the anode bosses are made and accordingly being welded to said anode bosses. The metal layer of that side of the coupons abutting the anode side liner is weldably compatible with the metallic material of which the anode side liner is made and accordingly is welded to said liner so that the liner is welded to the anode bosses through the coupons. In some instances wafers made of a single metal or metal alloy serve quite well as intermediates.

In most cases, it is preferred that the anode side liner be made of titanium or a titanium alloy, and the castable material from which the unitary central cell element be made is a ferrous material.

In the situation where the anode side liner is titanium material and the anode bosses are a ferrous material, then it is preferred to have vanadium wafers serve as the weldably compatible metal intermediates interposed between the anode bosses and the adjacent anode side liner so that the titanium anode side liner can be welded to the ferrous material anode bosses through the vanadium wafers. Vanadium is a metal which is weldably compatible with both titanium and ferrous material.

In some instances it is preferred to have the metal intermediates situated between the anode bosses and the adjacent anode side liner joined to the ends of the anode bosses by a film-forming process. Spraying a hot liquid metal, such as vanadium, is one film forming process. Another film forming process is carried out by soldering or brazing the metal to the anode bosses.

In some rare occasions it is found that no metal intermediate is required to be used between the liner and the anode bosses, and that the anode side liner can be directly bonded to the anode bosses by welding.

Another way of connecting an anode side liner to the unitary cell structure when these metals are weldably incompatible is that where no metal intermediate is used, but wherein the anode side liner is bonded directly to the anode bosses by explosion bonding or diffusion bonding.

In many instances it is desired that the anode side metal liner extends over the lateral face of the anode compartment peripheral structure so as to form a sealing face thereat for the membrane when the cell segments are squeezed together to form a cell series.

In most instances it is desired that the anode side liner be connected to the unitary central cell element at the ends of the anode bosses. However, this invention includes connecting the liner to the sides of these bosses and even connecting the liner to the central barrier between the bosses. Preferably, however, the anode side liner is welded to the ends of the anode bosses through an intermediate metal coupon or wafer.

Thus this invention also comprises a cathode side liner made of a metal sheet fitted over those surfaces of the unitary central cell element which would otherwise be exposed to the cathode compartment of the adjacent electrolysis cell.

This cathode side liner is made from an electrically conductive metal which is essentially resistant to corrosion due to the cathode compartment environment. Plastic liners may be used in come cases where provision is made for electrically connecting the cathode to the cathode bosses through the plastic. Also combinations of plastic and metal liners may be used. The same is true for anode side liners.

The cathode side liner must form the catholyte distribution and collection areas at the bottom and top of the cell. The liner must fit the sides of the compartment in such a manner as to force the catholyte to flow only over the face of the depolarized cathode.

Unlike the anode side liner, the cathode side liner may be directly connected to the gas compartment picture frame by welding, without a metal intermediate being disposed between the gas frame and the liner. A metal intermediate can be used, however. If so, then the metal intermediate must be weldably compatible with both the metal of the cathode side liner and the metal of which the unitary cell element is made.

In many instances it is desired that the unitary cell element be made of a ferrous material and the metal for the cathode side liner be selected from the group consisting of nickel, stainless steel, nickel alloys, chromium, zirconium, cobalt and moly alloys.

Nickel or stainless steel is usually the most preferred cathode side liner material.

As with the anode side liner, it is preferred that the cathode side metal liner also extend over the lateral face of the cathode compartment peripheral structure so as to form a sealing face thereat for the membrane when the cell segments are squeezed together to form a cell series. It also must extend over the gas compartment picture frame and form a gas tight seal, whether by seam welding or with bolts and gaskets.

BRIEF DESCRIPTION OF THE DRAWINGS

The invention can be better understood by reference to the drawing illustrating the preferred embodiment of the invention, and wherein like reference numerals refer to like parts in the different drawing figures, and wherein.

DETAILED DESCRIPTION OF THE PREFERRED EMBODIMENT OF THE INVENTION

Figure 1:
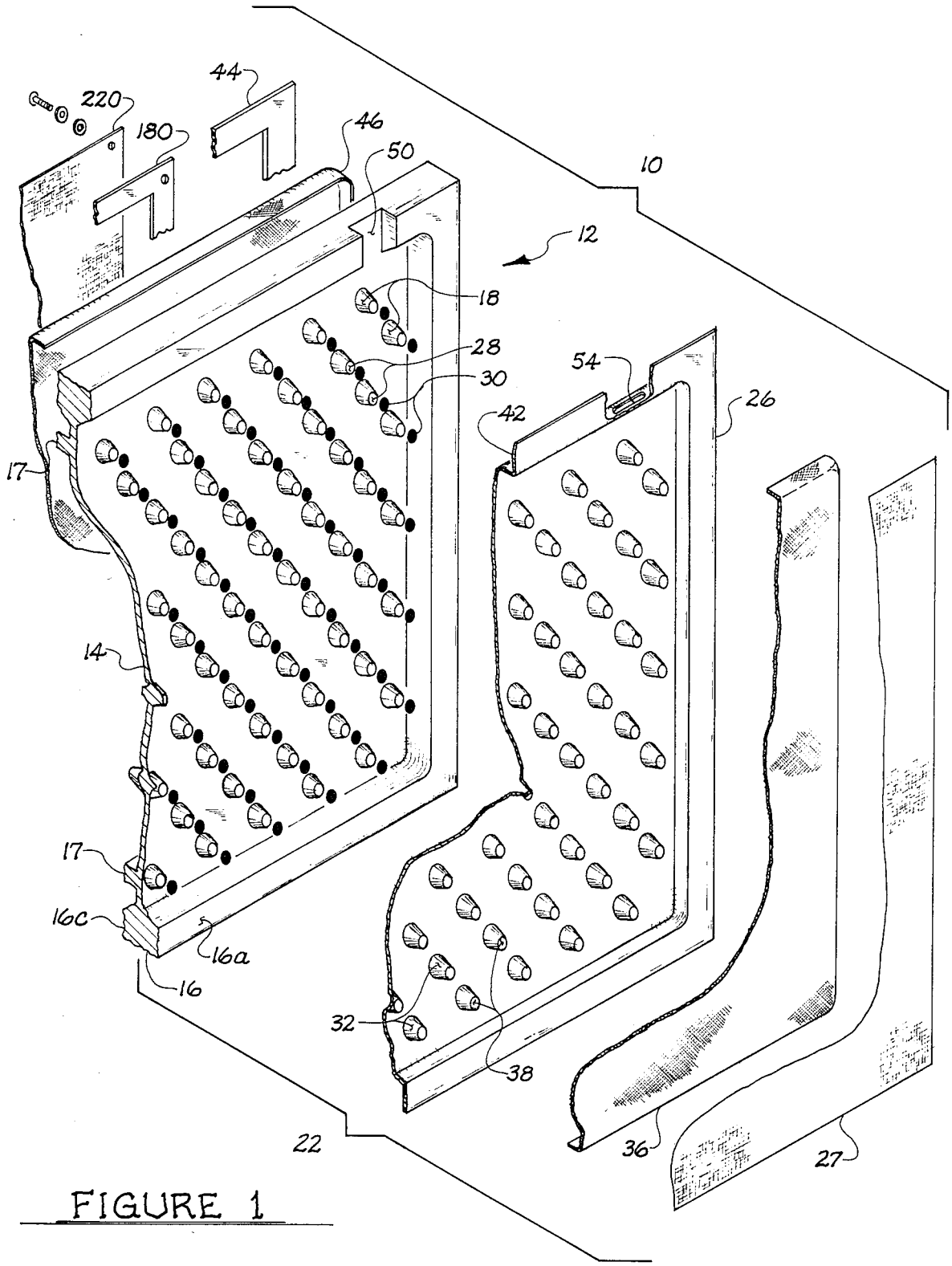
FIG. 1 is an exploded, partially broken-away perspective view of the unitary cell element 12 of this invention shown with accompanying parts forming one bipolar electrode type filter press-type cell unit 10 of a cell series of such cell units.
Figure 2:
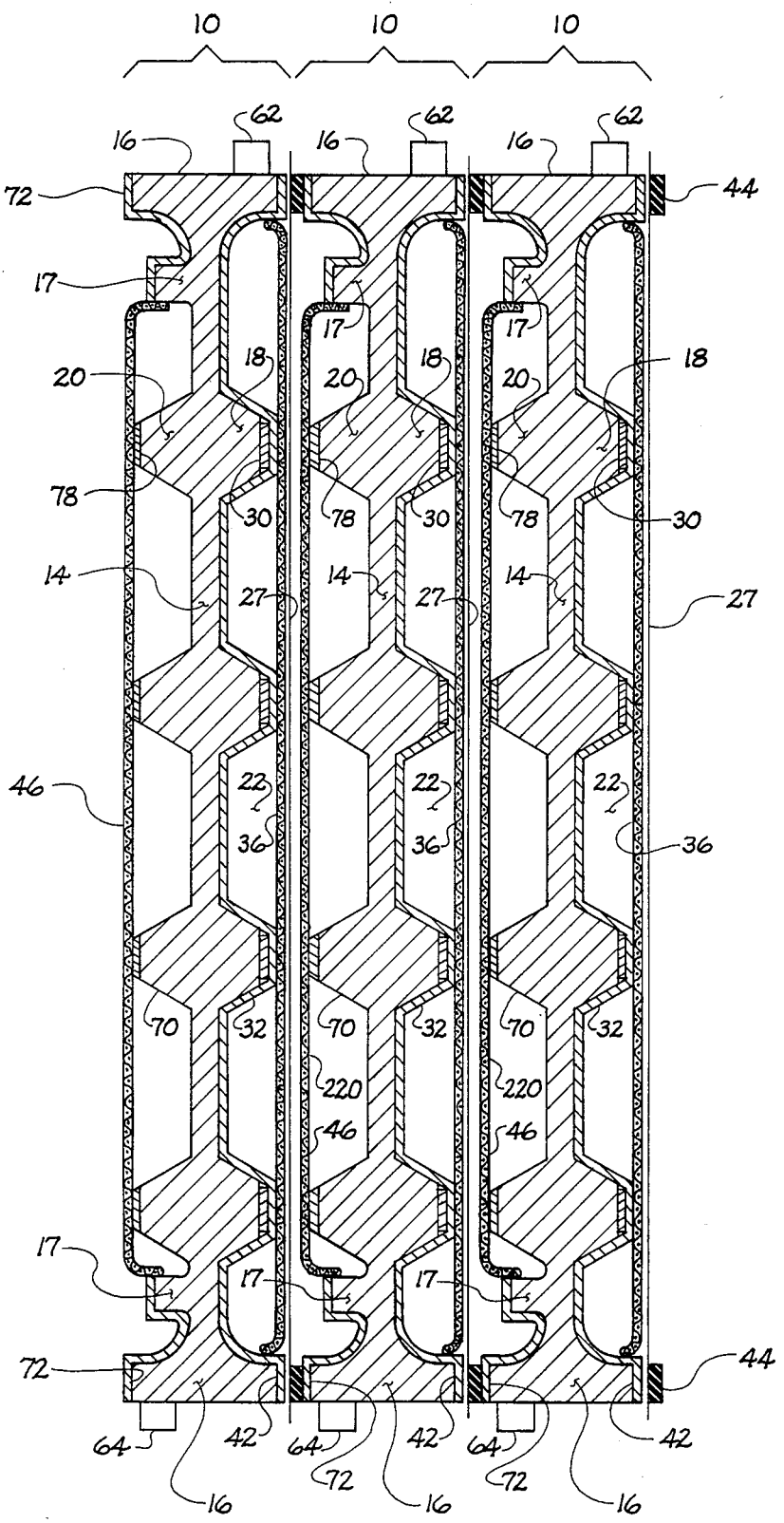
FIG. 2 is a cross-sectional side view of three filter press-type cell units 10 employing the unitary cell elements 12 of the present invention, said cell units shown as they would appear in a filter press cell series, said cross section being taken along and in the direction of line 2—2 in FIGS. 4 and 5.
Figure 3:
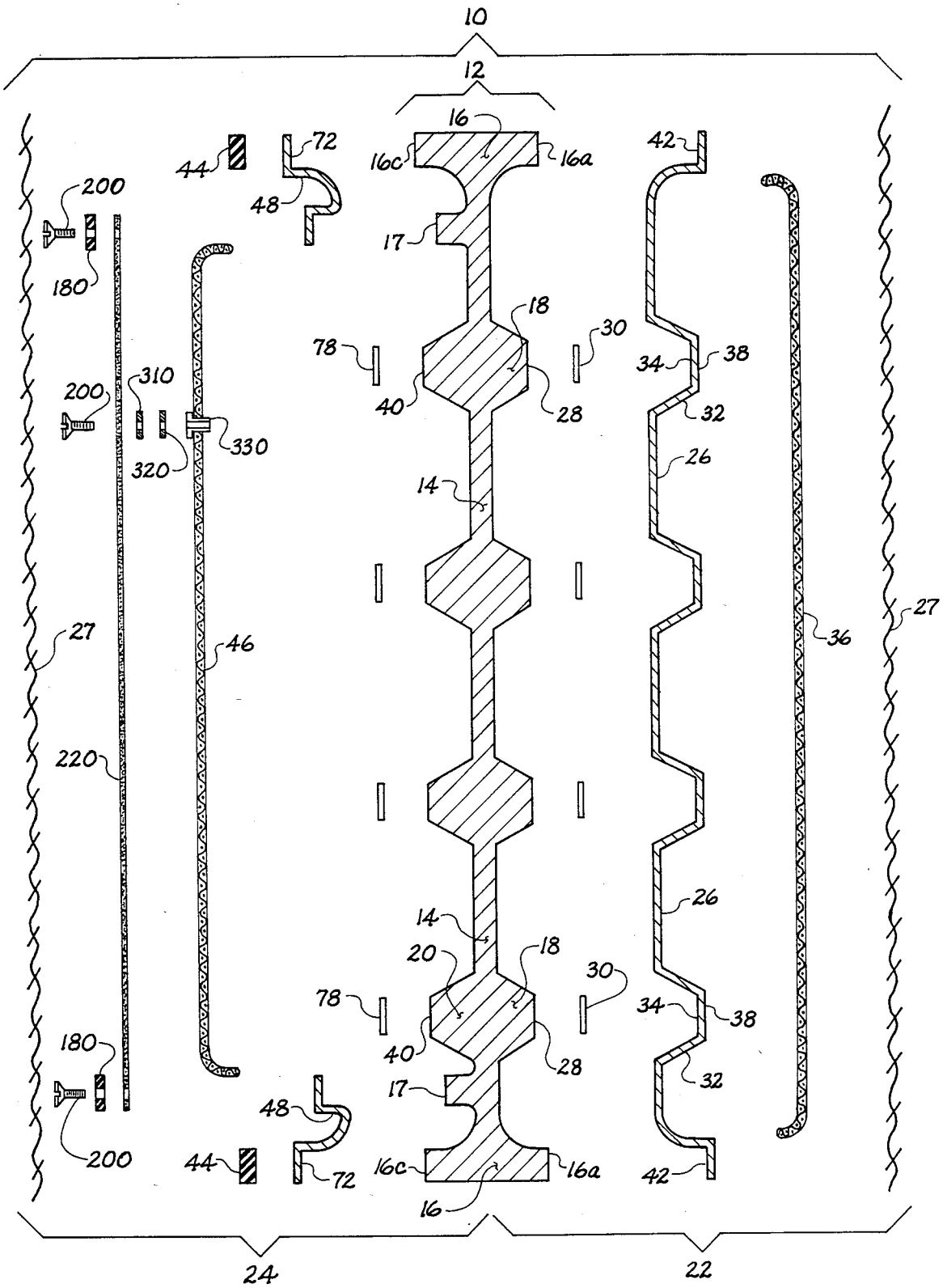
FIG. 3 is an exploded, sectional side view of cell structure used in forming a bipolar electrode-type, filter press-type cell unit 10 which employs the unitary central cell element 12 of this invention, said sectional view being taken along the imaginary cutting plane represented by line 3—3 in FIGS. 4 and 5 in the direction indicated, but said sectional view only showing the cell unit parts which actually touch said imaginary plane in order to omit parts from this FIG. 3 which tend to obscure these features.

Referring to FIGS. 1, 2 and 3, a "flat plate" electrode-type bipolar electrode-type, filter press-type electrolysis cell unit 10 is shown employing the preferred embodiment of the unitary central cell element 12 of this invention.

In the preferred embodiment, unitary central cell unit 12 is made of ductile iron. It has a solid central barrier 14, a peripheral flange 16 extending laterally from both sides of the periphery of the central barrier 14, protruding and spaced-apart anode bosses 18, protruding and spaced-apart cathode component bosses 20, and gas chamber picture frame 17.

By having these parts all integrally cast into one unit 12, many problems are simultaneously eliminated or greatly reduced. For example, most of the warpage problems, fluid leakage problems, electric current maldistribution problems, and complications of cell construction on a mass production basis are greatly alleviated. This simplicity of cell design allows cell units to be constructed which are much more reliable, but which are constructed at a much more economical cost.

Referring to FIGS. 1, 2 and 3, an anode compartment 22 of an adjacent electrolysis cell can be seen on the right side of central cell element 12. On the left side of cell structure 12, a cathode compartment 24 of a second adjacent electrolysis cell can be seen. Thus cell element 12 separates one electrolysis cell from another. One very important feature in cells of this type is to get electricity from one electrolysis cell to another as cheaply as possible.

On the anode compartment side (the right side on FIGS. 1, 2 and 3) of central structure 12, there is an anode side liner 26 made of a single sheet of thin titanium. This liner 26 is hot formed by a press in such a fashion so as to fit over and substantially against the surfaces of the unitary central cell unit 12 on its anode compartment side. This is done to protect the steel of cell structure 12 from the corrosive environment of the anode compartment 22 (FIG. 3). anode side liner 26 also forms the left boundary of anode compartment 22 with ion-exchange membrane 27 forming the right boundary (as shown in FIG. 3). Unitary cell element 12 is cast in such a fashion so that its peripheral structure forms a flange 16 which serves not only as the peripheral boundary of the anode compartment 22 but also as the peripheral boundary of the cathode compartment 24. Preferably the titanium liner is formed with no stresses in it in order to provide a liner which atomic hydrogen can not attack as rapidly to form brittle, electrically non-conductive titanium hydrides. Atomic hydrogen is known to attack stressed titanium more rapidly. Avoiding these stresses in the liner is accomplished by hot forming the liner in a press at an elevated temperature of about 900° F. to about 1,000° F. Both the liner metal and press are heated to this elevated temperature before pressing the liner into the desired shape. The liner may be then held in the heated press for about forty-five minutes to prevent formation of stresses in it as it cools to room temperature.

Titanium anode side liner 26 is connected to steel cell element 12 by resistance welding or capacitor discharge. This welding is accomplished indirectly by welding the anode side liner 26 to the flat ends 28 of the frustroconically shaped, solid anode bosses 18 through vanadium wafers 30. Vanadium is a metal which is weldable itself and which is weldably compatible with titanium and steel. Weldably compatible means that one weldable metal will form a ductile solid solution with another weldable metal upon the welding of the two metals together. Titanium and steel are not weldably compatible with each other, but both are weldably compatible with vanadium. Hence, vanadium wafers 30 are used as an intermediate metal between the steel anode bosses 18 and the titanium liner 26 to accomplish the welding of them together to form an electrical connection between liner 26 and central cell element 12 as well as to form a mechanical support means for central cell element 12 to supporting anode side liner 26.

The preferred fit of the anode side liner 26 against the central cell element 12 can be seen from the drawing (FIG. 2). The liner 26 has indented hollow caps 32 pressed into it. These caps 32 are frustroconically shaped, but are hollow instead of being solid as are the anode bosses 18. Caps 32 are sized and spaced so that they fit over and around anode bosses 18. Caps 32 are sized in depth of depression so that their interior ends 34 abut the vanadium wafers 30 when the vanadium wafers 30 are abutting the flat ends 28 of the anode bosses 18 and when these elements are welded together. The shape of these bosses and caps is not significant. They could be square shaped or any other convenient shape. However, their ends 28 should all be flat and should all lie in the same imaginary geometrical plane in the preferred embodiment. In fact these anode bosses and caps can be shaped and located so as to guide anolyte and gas circulation.

The titanium anode side liner pan 26 is resistance or capacitor discharge welded at the interior ends 34 of its indented caps 32 to the steel ends 28 of anode bosses 18 through the interposed, weldably compatible, vanadium wafers 30.

Anode 36 is a substantially flat sheet of expanded metal, punched plate or woven wire made of titanium having a ruthenium oxide catalyst coating on it. It is welded directly to the outside of the flat ends 38 of indented caps 32 of titanium liner 26. These welds form an electrical connection and a mechanical support means for anode 36. Other catalyst coatings can be used.

In FIG. 2 membrane 27 is seen to be disposed in a flat plane between the anode 36 of the one filter press cell unit 10 and the cathode 220 of the next adjacent filter press cell unit 10 so as to form an electrolysis cell between the central barrier 14 of each of the two adjacent unitary central cell elements 12.

Representative of the types of permselective membranes envisioned for use with this invention are those disclosed in the following U.S. Pat. Nos.: 3,909,378; 4,329,435; 4,065,366; 4,116,888; 4,126,588; 4,209,635; 4,212,713; 4,251,333; 4,270,996; 4,123,336; 4,151,053; 4,176,215; 4,178,218; 4,340,680; 4,357,218; 4,025,405; 4,192,725; 4,330,654; 4,337,137; 4,337,211; 4,358,412; and 4,358,545. These patents are hereby incorporated by reference for the purpose of the membranes they disclose.

Of course, it is within the purview of this invention for the electrolysis cell formed between the two cell segments to be a multi-compartment electrolysis cell using more than one membrane, e.g., a three-compartment cell with two membranes spaced from one another so as to form a compartment between them as well as the compartment formed on the opposite side of each membrane between each membrane and its respective adjacent filter press cell unit 10.

For fluid sealing purposes between membrane 27, and flange surface 16*a*, it is preferred for anode side liner 26 to be formed in the shape of a pan with an off-set lip 42 extending around its periphery. Lip 42 fits flush against the anode side of lateral face 16*a* of flange 16, this lateral face 16*a* being located on the anode side of the cell structure 12. The periphery of membrane 27 fits flush against anode side liner lip 42, and a peripheral gasket 44 fits flush against the other side of the periphery of membrane 27. In a cell series, as shown in FIG. 2, the gasket 44 fits flush against the off-set lip 72 of cathode liner 48 which is against lateral face 16*c* of the flange 16 on the cathode side of the next adjacent cell structure 12 and flush against membrane 27.

Although only one gasket 44 is shown, this invention certainly encompasses the use of gaskets on both sides of membrane 27. It also encompasses the situation where no lip 42 or 72 is used.

On the side of ductile iron central cell element 12 opposite the anode compartment side, i.e., the cathode side, there is no liner shown in the gas compartment. This is not to say that one may not be used.

Referring to FIGS. 2 and 3, the flange 16 forms the peripheral boundary of the cathode compartment 24, while the central barrier 14 and membrane 27 form its remaining boundaries. Spaced cathode component bosses 20 are solid, frustroconically shaped protrusions extending outwardly from central barrier 14 into gas compartment 21. Flat-surfaced, foraminous, stainless steel plate current collector 46 is welded directly to the flattened ends 40 of cathode component bosses 20. Again the shape of the bosses 20 are not important. They are preferably flat on their ends 40 and these ends 40 preferably all lie in the same geometrical plane. These cathode component bosses can be shaped and located so as to guide the gas circulation.

Figure 4:
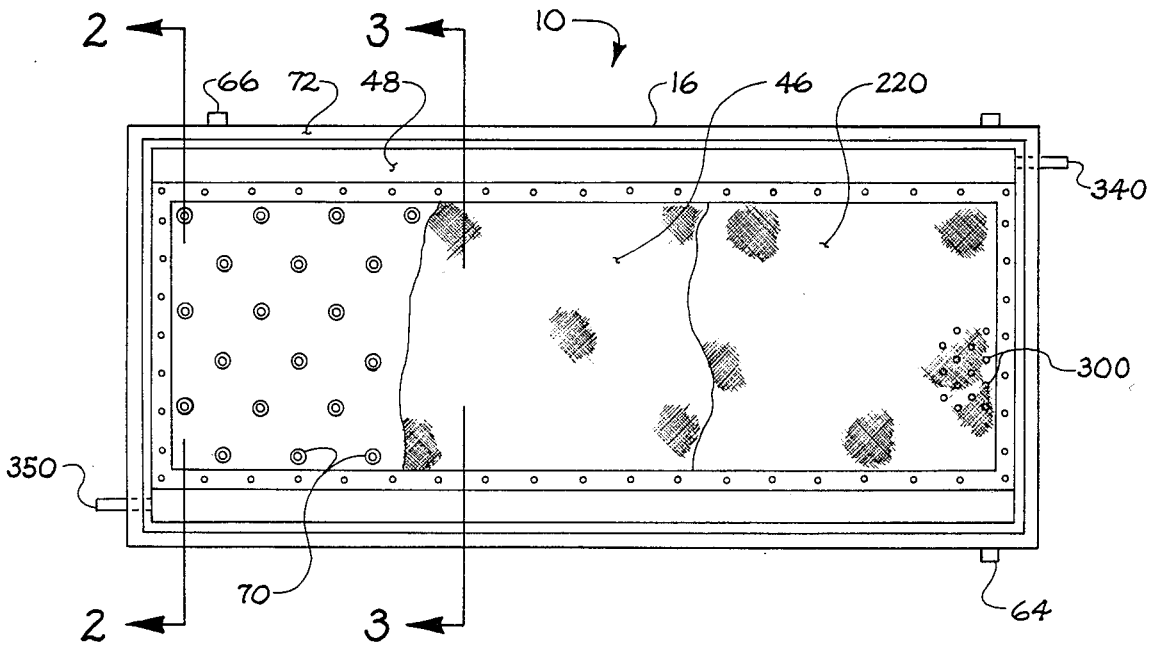
FIG. 4 is a partially broken-away front view of a bipolar electrode type filter press-type cell unit 10 which employs this invention and which is viewed from the cathode side.

When a metal liner is desired on the cathode compartment side because of the low depolarized cathode potential of unitary central cell element 12, it can easily be provided in the same manner and with similar limitations as is the anode compartment side liner 26 provided for anode compartment side of cell element 12, described above. Referring to FIGS. 2, 3, and 4, such a cathode side liner 48 is shown. It is made of a metal which is highly resistant to corrosive attack from the environment of the cathode compartment 24. The metal must also be sufficiently ductile and workable so as to be pressed from a single sheet of metal into the non-planar form shown. This includes being capable of having the caustic distributor and collector pressed into the single sheet. It is preferred that this cathode side liner 48 have an indented lip 72 extending around its periphery in a fashion so as to flushly abut the lateral face 16*c* of flange 16 on the side of central cell element 12 which is adjacent to the cathode compartment 24. Liner 48 may be connected to central cell element 12 by resistance seal welding of the liner inside flange to the gas chamber picture frame 17 or bolts and gaskets may be used. That is, this is preferable if the metal of the liner 48 and the central support element 12 are weldably compatible with each other. If these metals are not weldably compatible, then there should be used metal intermediates or combinations of intermediates which are weldably compatible with the metal of liner 48 and cell element 12.

Current collector 46 may be welded to the ends of the cathode component bosses 20 through an intermediate 78.

Metal intermediates 78, 30 for both the anode side and current collector may be metal wafers or metal coupons. By metal wafers, it is meant that the wafer be a single metal which is weldably compatible with both the metal of the cell element 12 and the metal of the respective liners 26 or 48. By metal coupons it is meant at least two layers of different metals bonded together to make up such a metal intermediate 78 or 30. The metals of such a coupon can be bonded together by methods such as explosion bonding or diffusion bonding. The ultimate criteria for such intermediates are that: they be highly electrically conductive; the metal lying against the cell element 12 be weldably compatible with the cell element metal; and the metal layer of the coupon laying against the liner be weldably compatible with the metal of that liner. It should be noted that coupons can have more than two layers of metal. One such coupon for the anode compartment side is a three layer explosion bonded coupon of titanium, copper and a ferrous material.

It will be noticed that both the flat-surfaced anode 36 has its peripheral edges rolled inwardly toward the cell element 12 away from the membrane 27. This is done to prevent the sometimes jagged edges of these electrodes from contacting the membrane 27 and tearing it.

It should be noted that the corners of central cell element peripheral flange 16 are built up. This is done to allow the cell to be operated at higher pressures than atmospheric. Of course, the shape of the cell can be round as well as rectangular, or any other convenient shape. A round shape would probably be the most practical for very high pressure operations.

Figure 5:
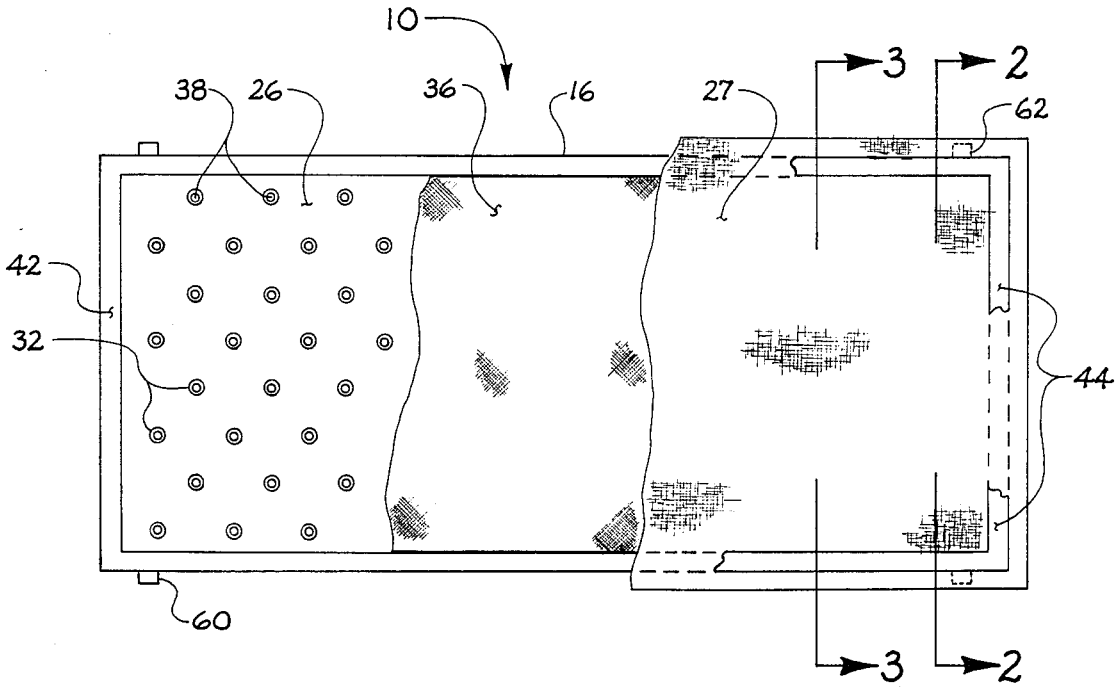
FIG. 5 is a partially broken-away front view of a bipolar electrode-type, filter press-type cell unit 10 which employs this invention and which is viewed from the anode side.

With brine as cell feed, the cell operates as follows. The feed brine is continuously fed into anode compartment 22 via duct 60 while fresh water may be fed into cathode compartment 24 via duct 64. (FIGS. 4 and 5). Electric power (D.C.) is applied across the cell series in such a fashion so that the anode 36 of each electrolysis cell is positive with respect to the cathode 220 of that electrolysis cell. For depolarized cathodes and non-depolarized anodes, the electrolysis proceeds as follows. Chlorine gas is continuously produced at the anode 36; sodium cations are transported through membrane 27 to the cathode compartment. In the cathode compartment 24 there is an aqueous solution of sodium hydroxide continuously formed. The chlorine gas and depleted brine continuously flow from the anolyte chamber 22 via duct 62 while sodium hydroxide continuously exit the cathode compartment 24 by duct 66. Depolarized electrodes can be used to suppress the production of hydrogen or chlorine or both if desired.

In operating the cell series as an electrolysis cell series for NaCl brine, certain operating conditions are preferred. In the anode compartment a pH of from about 0.5 to about 5.0 is desired to be maintained. The feed brine preferably contains only minor amounts of multivalent cations (less than about 80 ppb when expressed as calcium). More multivalent cation concentration is tolerated with the same beneficial results if the feed brine contains carbon dioxide in concentrations lower than about 70 ppm when the pH of the feed brine is lower than 3.5. Operating temperatures can range from 0° to 250° C., but preferably above about 60° C. Brine purified from multivalent cations by ion-exchange resins after conventional brine treatment has occurred is particularly useful in prolonging the life of the membrane. A low iron content in the feed brine is desired to prolong the life of the membrane. Preferably the pH of the brine feed is maintained at a pH below 4.0 by the addition of hydrochloric acid.

Preferably the pressure in the cathode compartment is maintained at a pressure slightly greater than that in the anode compartment, but preferably at a pressure difference which is no greater than a head pressure of about 1 foot of water. Preferably this pressure difference is controlled by surge tanks. These surge tank control of pressure is disclosed in U.S. Pat. No. 4,105,515 which is hereby incorporated by reference for the purposes of that disclosure.

Preferably the operating pressure is maintained at less than 7 atmospheres.

Usually the cell is operated at a current density of from about 1.0 to about 6.0 amperes per square inch, but in some cases operating above 6.0 amps/in.$^2$ is quite acceptable.

Anode compartment 22 and cathode compartment 24 both need fluid inlet and outlet ducts. Accordingly an anode compartment orifice inlet duct (not shown in FIG. 1), an anode compartment orifice outlet duct 50, and a cathode compartment orifice inlet and outlet ducts (not shown in FIG. 1) are cast in the body of the flange 16 in that part of the flange which contacts their respective anode compartment 22 and cathode compartment 24.

Inside these orifices, conduit leads need to be placed. These conduit leads are shown in FIGS. 4 and 5 as anolyte inlet conduit 60, anolyte outlet conduit 62, catholyte inlet conduit 64, and catholyte outlet conduit 66. Note the orifices themselves are not readily observable in FIGS. 4 and 5 inasmuch as the conduits inserted inside them tend to obscure them. Thus the orifices are not numbered as such in FIGS. 4 and 5, while the conduits themselves are not shown and numbered in FIG. 1 for the sake of clarifying their differences while simplifying the total drawing.

Now turning to a more general description of the invention. Besides ferrous materials such as iron, steel and stainless steel, cell element 12 can also be cast from any other castable metal or metal alloy such as nickel, aluminum, copper, chromium, magnesium, titanium, tantalum, cadmium, zirconium, lead, zinc, vanadium, tungsten, iridium, rhodium, cobalt, and their alloys. Cathode side liners 48 are usually chosen from these materials also, with the general exception of zinc, magnesium, aluminum, copper, cadmium, lead, iron and steel.

The anode side liner 26 and the cathode side liners 48 are preferably made of sufficiently workable metallic materials as to be capable of a single sheet of it being formed into the shape in which they are shown in the drawing. This includes the ability to be pressed so that they have frustroconically shaped caps 32. It should also be understood that the invention is not limited to the caps 32 being frustroconically shaped nor limited to the anode and cathode component bosses 18 and 20 being frustroconically shaped. They can be shaped and located so as to direct the flow of electrolytes in compartment 20 and gas within the compartment. Bosses 18 and 20 should have their ends 28 and 40 flat and parallel with the flat electrode surface to which they are going to be connected. The ends 28 and 40 of the bosses 18 and 20 should present sufficient surface area to which electrical connections can be made to their respective electrodes to provide an electrical path with sufficiently low electrical resistance. The bosses 18 and 20 should be spaced so they provide a fairly uniform and fairly low electrical potential gradient across the face of the electrode to which they are attached. They should be spaced so that they allow free electrolyte or gas circulation from any unoccupied point within their respective electrolyte or gas compartment to any other unoccupied point within that compartment. Thus the bosses will be fairly uniformly spaced apart from one another in their respective compartments. It should be noted here that although anode bosses 18 and cathode component bosses 20 are shown in a back to back relationship across central barrier 14, they need not be. They can be offset from each other across barrier 14.

The materials from which anode and cathode component bosses 18 and 20 are made are, of course, the same as that of the cell element 12 since part of this invention is to make them an integral part of that cell element.

Of course, the metals from which anode side liner 26 and cathode side liner 48 are made are usually different because of the different electrolyte corrosion and electrolytic corrosion conditions to which they are exposed. This is true not only in chlor-alkali cell electrolytes, but also in other electrolytes with the exception of depolarized cathode cells. Thus the metals chosen must be chosen to fit the conditions to which they are going to be exposed. Typically titanium is the preferred metal for the anode compartment liner 26. Other metals suitable for such conditions can usually be found in the following group: titanium, titanium alloys, tantalum, tantalum alloys, niobium, niobium alloys, hafnium, hafnium alloys, zirconium and zirconium alloys.

The number of metals suitable for the cathode side liner 48 is limited by the low cathode potential of a depolarized cathode cell. Nickel or stainless steel materials are usually the preferred as the metals for the cathode side liner. Other usually suitable liner 48 material includes chromium, titanium, tantalum, zirconium, vanadium, tungsten, iridium, cobalt, moly and alloys of each of these metals.

As a general rule, the metal which is used for cathode side liner 48 is also suitable for use in making the current collector 46. Also if a porous metal depolarized cathode 220 is used, the depolarized cathode 220 may be a porous teflon back with a active front surface of porous teflon, graphite and a catalyst. It may also have a current collector impeded or attached to the front surface. This is similarly true for the metal of the anode side liner 26 and its anode 36.

When a liner metal is used which is weldably incompatible with the metal of the cell structure 12, and when the liner 26 or current collector 46 is to be connected to the cell structure 12 by welding, then metal intermediates are positioned between the cell structure bosses and the metal liner at the location where the welds are to be made. These metal intermediates may be in the form of a single metal wafer, in the form of a multilayered metal coupon, or in the form of a metal film formed either on the cell structure 12 or the liner 26 or 48.

Figure 6:
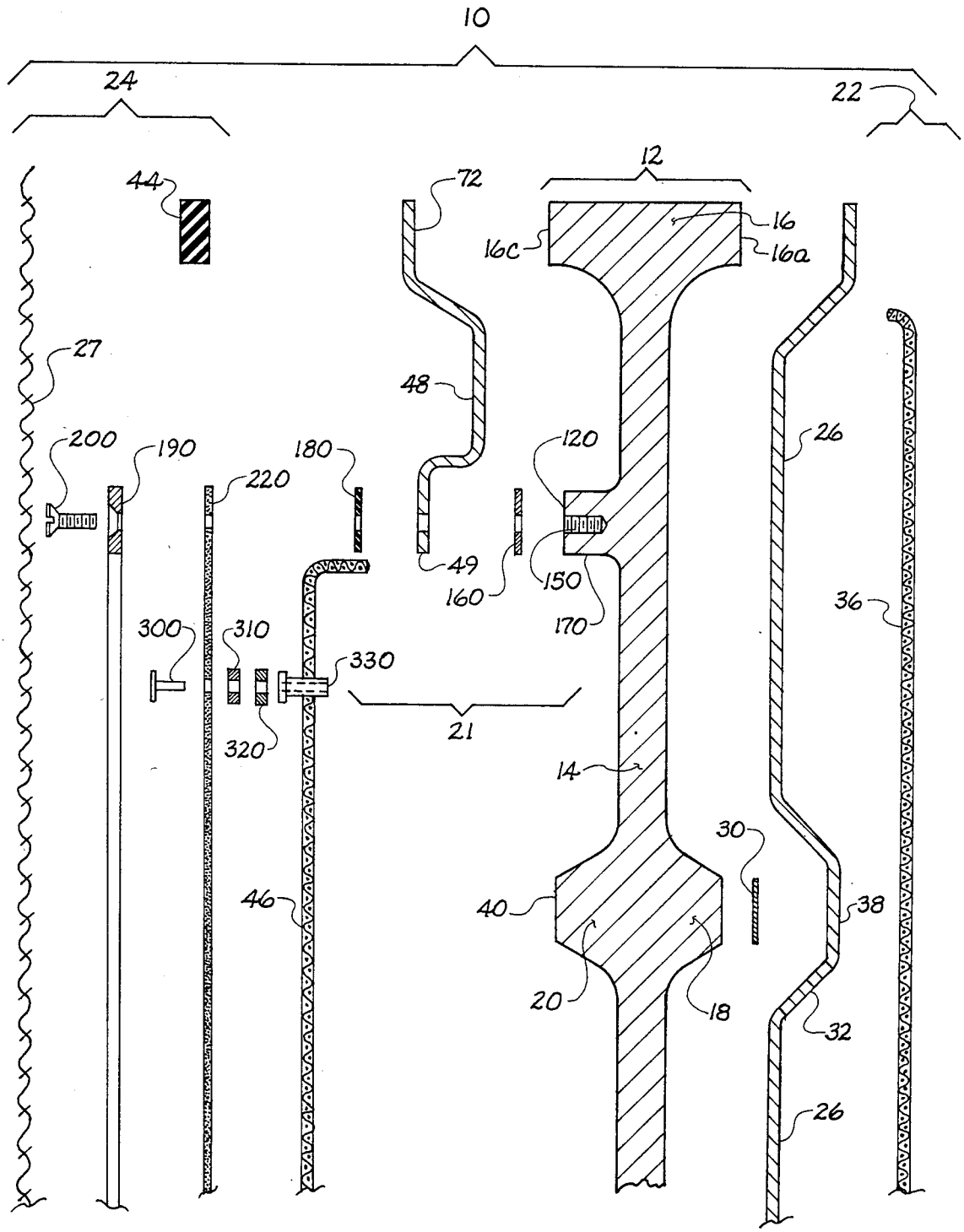
FIG. 6 is an exploded, sectional side view of the cell structure used in forming a bipolar electrode-type, filter press-type cell unit 10 which employs the unitary central cell element 12 of this invention, and which employs a depolarized electrode 130. Said sectional view being taken along the imaginary cutting plane represented by line 3—3 in FIGS. 4 and 5 in the direction indicated, but said sectional view ony showing the cell unit parts which actually touch said imaginary plane in order to omit parts from this FIG. 6 which tend to obscure these features and including the parts necessary for the use of a depolarized electrode.

The present invention is illustrated in FIG. 6 employing a depolarized electrode. In the illustrated case, the electrode is a depolarized cathode. It should be understood that the invention can also be used with a depolarized anode. In addition, it can be used with both a depolarized anode and a depolarized cathode.

The cell unit 10 has a central cell element 12 which is shown having a flange 16 with lateral face 16*c* on the cathode side and lateral face 16*a* on the anode side. It also contains bosses 18 on the anode side and bosses 20 on the cathode side and the gas picture frame 17. A central barrier 14 prevents flow from one side of the central cell element 12 to the other side. The anode side of the central barrier 12 is lined with an anode liner 26, which will contact anode 36 when the cell is assembled. An intermediate metal coupon 30 is present to aid in the welding of the anode compartment liner 26 to the anode bosses 18.

On the cathode side of the central cell element 12, there are a plurality of depolarized electrode support bosses 20 which lie in a plane below the plane of the gas picture frame 17 on the cathode side.

A current collector 46 is welded to the depolarized electrode support boss 20 on the flat end 40 of boss 20. The depolarized cathode 220 (porous teflon type) is fastened using a silver plated stainless steel pop rivet 300 which passes through depolarized cathode 220, conductive gasket 310, a silver plated washer 320 and into a blind silver plate stainless steel eyelet 330 which is in a hold in the silver plated stainless steel current collector 46. Electrical current flows from the front face of the depolarized cathode 220 through the pop rivet 300 through the washer 310 and the eyelet 330 to the current collector 46 and through the current collector 46 to the weld between current collector 46 and into central element 14. All of the electrical connections are electroplated with silver because the low potential of a depolarized cathode cell form hydroxyl coating on most metals which are poor conductors.

An ion exchange membrane 27 is positioned against gasket 44, when the cell is assembled. As can be seen, when the cell is assembled, two chambers are formed on the cathode side of the cell unit 10. A first chamber 21 (gas compartment) is formed between the depolarized cathode 220 and the central barrier 14. A second chamber 24 (caustic compartment) is formed between the ion exchange membrane 27 and the depolarized electrode 220. The gas chamber 21 is sealed at the picture frame 17 by gaskets 160. The caustic compartment 24 is sealed from the gas compartment 21 by gasket 180. Screws 200 apply force through a picture frame 190 to the face of the depolarized cathode 220 to gasket 180 to cathode liner 48 to gasket 160 to the gas picture frame 17 which is tapped to receive screw 200. The gas compartment 21 is operated about 2 psig higher than the cathode compartment 24 (to force the gas through the pores). Cathode compartment 24 is operated at about 350 mm of water above the anode compartment 22 (to force the membrane 27 against the anode 36 so the caustic can flow over face of the depolarized cathode 220).

In operation of the cell illustrated in FIG. 6, an oxygen-containing gas is introduced into the first chamber 21 and electrolyte is force circulated through the the second chamber 24. The electrolyte flows into the porous areas of the depolarized cathode 220 from the second chamber 24. The oxygen-containing gas flows from the first chamber 21 into the porous areas of the depolarized cathode 220. Inside the depolarized cathode, electrochemical reactions are caused to occur between the electrolyte and the oxygen-containing gas. The products of electrolysis in a chlor-alkali electrolytic cell is hydroxyl ions, which mixes with the sodium ions in the electrolyte to form sodium hydroxide. The sodium hydroxide is removed from the second chamber. Additional electrolyte flows through the ion exchange membrane 27 into the second chamber. In addition, water may optionally be added to the second chamber 24. As the oxygen in the oxygen-containing gas is consumed, additional oxygen-containing gas may be introduced into the first chamber 21 through port 340 (FIG. 4). Any caustic that weeps through the porous cathode may be removed at port 350 (FIG. 4).

We claim:

1. In a cell structure used in forming a bipolar, depolarized electrode, filter press electrolytic cell unit, which unit is capable of being combined with other cell units to form a cell series;

wherein in said series the cell structure is separated from adjacent cell structures by ion-exchange permselective membranes which are sealably disposed between each of the cell structures so as to form a plurality of electrolysis cells;

each of said electrolysis cells having at least one planarly disposed membrane separating each cell into two electrode compartments, an anode compartment and a cathode oompartment;

wherein at least one of said eleotrode compartments comprises an electrolyte compartment in contact with the ion exchange membrane, a porous electrode component in contact with said electrolyte compartment and a gas chamber in contact with the porous electrode component on a side opposite the side contacting the electrolyte compartment;

said cell structure additionally having a central barrier which physically separates an anode compartment of an electrolysis cell located on one side of the barrier from a cathode compartment of an adjacent electrolysis cell located on the opposite side of the barrier;

said central barrier at least having a planarly disposed anode component situated in its adjacent anode compartment and at least having a planarly disposed cathode component situated in its adjacent cathode compartment;

said central barrier having the anode component of the adjacent anode compartment electrically connected through it to the cathode component of the adjacent cathode compartment;

said anode and cathode compartments which are adjacent to the central barrier having a peripheral structure around their periphery to complete the physical definition of said compartments;

said central barrier forming part of a gas compartment in the compartment adjacent to a depolarized electrode;

said cell structure also having an electrical current transfer means associated with it for providing electrical current paths through the central barrier from its adjacent cathode compartment to its adjacent anode compartment;

and which cell structure includes anode component and cathode component stand-off means for maintaining the anode component and cathode component of the two electrolysis cells adjacent to the central barrier at a predetermined distances from the central barrier;

the improvement which comprises:

the central barrier, the anode and cathode compartment peripheral structures, the anode component stand-off means, the cathode component stand-off means, and at least part of the electrical current transfer means all being integrally formed into a unitary central cell element made from a single casting of castable metal; and, further said castable metal being electrically conductive so as to be the part of the electrical current transfer means which transfers electricity through the central barrier from the adjacent cathode compartment of the adjacent anode compartment; and said unitary central cell element being formed in such a fashion so as to provide the structural integrity required to physically support the contents of the adjacent electrolyte compartments as well as to support the associated electrolysis cell appurtenances which are desired to be supported by the unitary central cell element; and said anode component stand-off means and that part of the electrical current connecting means located in the unitary central cell element on the anode side of the central barrier being combined into a multiplicity of anode component bosses projecting a predetermined distance outwardly from the central barrier into the anode compartment adjacent to the central barrier, said anode component bosses being capable of being mechanically and electrically connected either directly or indirectly to the anode component of said anode compartment; and said cathode component stand-off means and that part of the electrical current connecting means located on the cathode side of the central barrier being combined into a multiplicity of cathode component bosses projecting a predetermined distance outwardly from the central barrier into the cathode compartment adjacent to the central barrier, said cathode component bosses being capable of being mechanically and electrically connected either directly or indirectly to the cathode component; and said anode component bosses being spaced apart in a fashion such that fluids or gases can freely circulate throughout at least a portion of the adjacent anode compartment, and, likewise, said cathode component bosses being spaced apart in a fashion such that fluids or gases can freely circulate throughout at least a portion of the adjacent cathode compartment;

a gas inlet passing through the peripheral structure of the central barrier into the one of the electrode chambers between the central barrier and its electrode component, an integral gas compartment inside an electrolyte compartment with a sealable face.

2. The improvement of claim 1 wherein the castable metal of the unitary central cell element is selected from the group consisting of: iron, steel, stainless steel, nickel, aluminum, copper, chromium, magnesium, tantalum, zirconium, lead, zinc, vanadium, tungsten, iridium, rhodium, cobalt, alloys of each, and alloys thereof.

3. The improvement of claim 1 wherein the metal of the unitary central cell element is selected from the group consisting of ferrous metals.

4. The improvement of claim 1 which further comprises an anode side liner made of a metal sheet fitted over those surfaces on the anode compartment side of the cell structure which would otherwise be exposed to the corrosive environment of the anolyte compartments;

said anode side liner being an electrically conductive metal which is essentially resistant to corrosion due to the anode compartment environment;

said metal liner being formed so as to fit over and around the anode bosses and said liner being connected to the unitary central cell element at the anode bosses; and said liner being depressed sufficiently around the spaced anode bosses toward the central barrier in the spaces between the bosses so as to allow free circulation of the anolyte between the lined unitary central cell element and the membrane of the adjacent anolyte chamber, the liner replacing the unitary central cell element surface adjacent to the anolyte chamber as one boundary contacting the anolyte.

5. The improvement of claim 4 wherein the metal liner is connected to the anode bosses by welding through a metal intermediate which is disposed between the bosses and the liner, the metal of the metal intermediate being not only weldable itself, but also being weldably compatible with both the metal of the anode side liner and the metal of which the unitary central cell element is made, that is weldably compatible with both metals to the point of being capable of forming a ductile solid solution with them at welds of them upon their welding.

6. The improvement of claim 4 wherein the unitary cell element is made of a ferrous material and wherein the anode side liner is made of a metallic material selected from the group consisting of titanium, titanium alloys, tantalum, tantalum alloys, niobium, niobium alloys, hafnium, hafnium alloys, zirconium and zirconium alloys.

7. The improvement of claim 6 wherein there are metal coupons situated in an abutting fashion between the anode bosses and the anode side liner, with each coupon having at least two metal layers bonded together and with the outside metal layer of one side of the coupon abutting the anode boss and the outside metal layer of the opposite side of the coupon abutting the anode side liner, the metal layer of the coupons which abuts each anode boss being weldably compatible with the ferrous material of which the anode bosses are made and accordingly being welded to said anode bosses, and the metal layer of that side of the coupons abutting the anode side liner being weldably compatible with the metallic material of which the anode side liner is made and accordingly being welded to said liner so that the liner is welded to the anode bosses through the coupons.

8. The improvement of claim 4 wherein the anode side liner is made of titanium or a titanium alloy, and wherein the castable material from which the unitary central cell element is made is a ferrous material.

9. The improvement of claim 8 wherein vanadium wafers are interposed between the anode bosses and the adjacent anode side liner, and the titanium anode side liner is welded to the ferrous material bosses through the vanadium wafers.

10. The improvement of claim 4 wherein the metal intermediates situated between the anode bosses and the adjacent anode side liner are joined to the ends of the anode bosses by a film-forming process.

11. The improvement of claim 4 wherein no metal intermediate is used between the liner and the anode bosses, but wherein the anode side liner is directly bonded to the anode bosses by welding.

12. The improvement of claim 4 wherein no metal intermediate is used, but wherein the anode side liner is bonded directly to the anode bosses by explosion bonding or diffusion bonding.

13. The improvement of claim 4 wherein the anode side metal liner extends over the lateral face of the anode compartment peripheral structure so as to form a sealing face thereat for the membrane when the cell segments are squeezed together to form a cell series.

14. The improvement of claim 4 wherein the anode side liner is connected to the unitary central cell element at the ends of the anode bosses.

15. The improvement of claim 4 wherein the anode side liner is welded to the ends of the anode bosses through an intermediate metal coupon or wafer.

16. The improvement of claim 1 which further comprises a cathode side liner made of a single metal sheet fitted over those surfaces of the unitary central cell element which would otherwise be exposed to the cathode compartment of the adjacent electrolysis cell;

said cathode side liner being an electrically conductive metal which is essentially resistant to corrosion due to the cathode compartment environment;

said liner being depressed sufficiently around the spaced cathode bosses toward the central barrier in the spaces between the bosses so as to allow free circulation of the catholyte between the lined unitary central cell element and the membrane of the adjacent catholyte chamber, the liner replacing the unitary central cell element surface adjacent to the catholyte chamber as one boundary contacting the catholyte.

17. The improvement of claim 16 wherein the metal liner is connected to the cathode bosses by welding through a metal intermediate which is disposed between the bosses and the liner, the metal of the metal intermediate being not only weldable itself, but also being weldably compatible with both the metal of the cathode side liner and the metal of which the unitary cell element is made, that is weldably compatible with both metals to the point of being capable of forming a ductile solid solution with them at the welds upon welding.

18. The improvement of claim 16 wherein the unitary cell element is made of a ferrous material and wherein the cathode side metal liner is selected from the group consisting of ferrous materials, nickel, nickel alloys, chromium, tantalum, cadmium, zirconium, lead, zinc, vanadium, tungsten, iridium, and cobalt.

19. The improvement of claim 16 wherein there are metal coupons situated between the cathode bosses and the cathode side liner, with each coupon having at least two metal layers bonded together, the metal layer of the coupons which abuts each cathode boss being weldably compatible with the ferrous material of which the anode bosses are made and accordingly being welded to said cathode bosses, and the metal layer of that side of the coupons abutting the cathode side liner being weldably compatible with the metallic material of which the cathode side liner is made and accordingly being welded to said liner so that the liner is welded to the cathode bosses through the coupons.

20. The improvement of claim 16 wherein the metal of the unitary central cell element, of the cathode side liner, and of the cathode of the adjacent electrolysis cell are all selected from the group consisting of ferrous materials.

21. The improvement of claim 16 wherein the metal intermediates situated between the cathode bosses and the adjacent cathode side liner are joined to the ends of the cathode bosses by a film-forming process.

22. The improvement of claim 16 wherein the metal of said cathode side liner is compatible with the direct welding of it to the metal of the unitary central cell element and also directly weldable to the cathode of the cathode compartment;

the metal liner being formed so as to fit over and around the ends of the cathode bosses and welded directly on one side of the liner to the bosses in a manner so to provide an electrical connection between the unitary central cell element and the cathode which itself is directly welded to the opposite side of the cathode side liner.

23. The improvement of claim 16 wherein the cathode side metal liner extends over the lateral face of the cathode compartment peripheral structure so as to form a sealing face thereat for the membrane when the cell segments are squeezed together to form a cell series.

24. A process of electrolyzing sodium chloride brine comprised of passing electricity through a series of electrolysis cells whose cell structures are comprised of adjoining unitary cell elements like those defined in claim 1.

25. The process of claim 24 wherein a cation exchange membrane is used to separate said anode compartment from said cathode compartment.

26. The process of claim 25 wherein the cation exchange membrane has sulfonic acid groups as its functional groups.

27. The process of claim 25 wherein the cation exchange membrane has carboxylic acid groups as its functional groups.

28. The process of claim 25 wherein the cation exchange membrane comprises a combination of sulfonic acid groups and carboxylic acid groups.

29. The process of claim 25 wherein the cation exchange membranes are reinforced to impair deforming during electrolysis conditions.

30. The process of claim 25 wherein the cation exchange membranes are not reinforced to decrease the electrical resistivity of said membrane.

31. The process of claim 24 wherein the sodium chloride aqueous solution electrolyzed is maintained at a pH of between about 0.5 and about 5.0 during electrolysis.

32. The process of claim 24 wherein the brine solution electrolyzed in the cells contains no more than about 0.08 milligrams per liter of calcium.

33. The process of claim 24 wherein calcium is removed from the brine to a level of concentration of no greater than about 0.08 milligrams per liter prior to the brine being electrolyzed by a multivalent cation removal process which includes passage of the brine through at least one chelating ion exchange resin bed.

34. The process of claim 24 which includes electrolyzing brine which contains carbon dioxide in concentrations no greater than about 70 parts per million as measured just prior to the brine being electrolyzed when the pH of the brine is maintained at a level lower than 3.5 by a process which includes the addition of hydrochloric acid to the brine prior to its being electrolyzed.

35. The process of claim 24 wherein the temperature of the brine is maintained at a level greater than about 80° C.

36. The process of claim 24 which further comprises maintaining the catholyte chamber pressure at a slightly greater pressure than the pressure of the anode compartment so as to gently urge the permselective, ion-exchange membrane separating the two compartments toward and against a "flat plate" foraminous anode disposed parallel to the planarly disposed membrane; which anode is electrically and mechanically connected to the anode bosses of the unitary cell element.

37. The process of claim 24 which further comprises operating the cell at an electrolyte pressure of less than about seven atmospheres.

38. The process of claim 24 which further comprises operating the electrolysis cell at an electrical current density of from about 0.5 to about 5.0 amperes per square inch of anode surface.

39. The process of claim 24 wherein the electrolysis is carried out while circulating the anolyte through the anode compartment via forced circulation.

40. The process of claim 24 wherein the electrolysis is carried out while circulating the catholyte through the cathode via forced circulation.

41. The process of claim 24 wherein the electrolysis is carried out while circulating both the anolyte and catholyte through their respective compartments via forced circulation.

42. The process of claim 24 wherein the soluble silica is removed from the brine electrolyzed to a level of concentration of no greater than about 4 mg./liter prior to its being electrolyzed.

43. The process of claim 24 wherein iron compounds and other multivalent metals are removed from the brine electrolyzed to a level of concentration of no greater than about 0.05 mg./liter prior to the electrolysis of the brine in order to increase the life of the membrane and electrodes.

44. The process of claim 24 wherein the aqueous sodium hydroxide solution is produced with a sodium chloride content of no more than 350 ppm based on 100% sodium hydroxide.

45. The process of claim 24 wherein sulfate is removed from the brine electrolyzed to a level of concentration of no greater than about 5.0 g./liter prior to the electrolysis of the brine.

46. The process of claim 24 wherein the electrolysis is carried out while circulating the catholyte through the cathode via a gas lift method.

47. The process of claim 24 wherein the electrolysis is carried out while circulating the anolyte through the anode via a gas lift method.

48. The improvement of claim 1 wherein the cathode component is the porous electrode contacting a gas chamber which is located between the cathode component and the central barrier, and a means for feeding an oxygen-containing gas through the gas inlet into the gas chamber.

49. The improvement of claim 1 wherein the anode component is the porous electrode contacting a gas chamber which is located between the anode component and the central barrier, and a means for feeding a hydrogen-containing gas through the gas inlet into the gas chamber.

* * * * *